US007055510B2

(12) United States Patent
Deane et al.

(10) Patent No.: US 7,055,510 B2
(45) Date of Patent: Jun. 6, 2006

(54) INTERNAL COMBUSTION ENGINE HAVING AN INTERNAL BARRIER DEVICE TO REDUCE OIL CARRY-OVER

(75) Inventors: Daniel Deane, Peterborough (GB); Frank George Hughes, Lincolnshire (GB); John Robert Sherwood, Peterborough (GB)

(73) Assignee: Perkins Engines Company Limited, Peterborough ( * ) Notice: Subject to any disclaimer, the term of this patent is extended or adjusted under 35 U.S.C. 154(b) by 0 days.

(21) Appl. No.: 10/830,233

(22) Filed: Apr. 23, 2004

(65) Prior Publication Data

US 2005/0011503 A1 Jan. 20, 2005

(30) Foreign Application Priority Data

Apr. 25, 2003 (EP) ..... 03252618

(51) Int. Cl.
*F02M 25/07* (2006.01)

(52) U.S. Cl. ..... 123/572

(58) Field of Classification Search ..... 123/572–574, 123/41.86

See application file for complete search history.

(56) References Cited

U.S. PATENT DOCUMENTS

| | | | | |
|---|---|---|---|---|
| 1,329,343 | A | 1/1920 | Raba | |
| 1,893,183 | A * | 1/1933 | Sleffel | 123/543 |
| 2,252,974 | A * | 8/1941 | Lowther | 123/1 R |
| 3,241,537 | A * | 3/1966 | Jones | 123/572 |
| 4,667,647 | A * | 5/1987 | Ohtaka et al. | 123/573 |
| 4,922,881 | A * | 5/1990 | Tamba et al. | 123/572 |
| 4,958,613 | A * | 9/1990 | Hiraoka et al. | 123/572 |
| 5,617,834 | A * | 4/1997 | Lohr | 123/572 |
| 6,425,451 | B1 * | 7/2002 | Yoshida et al. | 180/219 |
| 6,431,157 | B1 * | 8/2002 | Marcil | 123/568.11 |
| 6,435,170 | B1 * | 8/2002 | Hamelink et al. | 123/572 |
| 6,443,136 | B1 * | 9/2002 | Suganami et al. | 123/572 |

FOREIGN PATENT DOCUMENTS

| | | |
|---|---|---|
| DE | 346979 | 1/1922 |
| EP | 1 199 448 | 4/2002 |
| GB | 2 260 365 | 4/1993 |

OTHER PUBLICATIONS

Patent Abstracts of Japan, vol. 1995 #3, Apr. 28, 1995 & JP 06 336911 of Dec. 6, 1994, Toyota Autom Loom Works Ltd.
Patent Abstracts of Japan, vol. 1996 #11, Nov. 29, 1996 & JP 08 189325 of Jul. 23, 1996, Kawasaki Heavy Ind. Ltd.
Partial European Search Report from European Application No. 0 325 2618.

* cited by examiner

*Primary Examiner*—Marguerite McMahon

(57) ABSTRACT

To prevent seal failure in internal combustion engines, blow-by gasses leaking past the piston rings require venting. However, moving engine components cause airborne oil particles to be mixed in with the gasses. Depending on breather system and engine type, oil carry-over can cause increased operating costs, reduced engine performance and emissions issues. The present invention provides a simple and inexpensive barrier device fitted in a cylinder block. The device is positioned such that oil particles impact on the device and coagulate to form droplets which subsequently run back to the crankcase. Some advantages provided by the present invention are that the engine envelope is unaffected, the barrier device is the only additional part, and the cylinder block requires no or minimal adaptation.

17 Claims, 7 Drawing Sheets

INTERNAL COMBUSTION ENGINE HAVING AN INTERNAL BARRIER DEVICE TO REDUCE OIL CARRY-OVER

TECHNICAL FIELD

The present invention relates to reducing oil carry-over in internal combustion engines. In particular, but not exclusively, the invention relates to a barrier device provided in the cylinder block of an internal combustion engine to reduce the amount of oil being carried over from the crankcase to the crankcase breather system.

BACKGROUND

Internal combustion engines suffer from a process called blow-by where combustion gasses leak past the piston rings into the crankcase. To prevent seal damage these gasses will have to be vented, which can be done by a closed circuit breather system (CCB) or an open circuit breather system (OCB). When using an OCB, the gasses flow from the crankcase to the cylinder head and are from there vented to atmosphere. With a CCB, the gasses flow from the crankcase to the cylinder head and are from there re-introduced into the induction system, where they are burned off and subsequently depart the engine via the conventional exhaust system.

A major problem associated with both OCB and CCB systems is that the blow-by gasses usually carry a substantial amount of oil particles caused by reciprocating and rotating elements in the engine. This process is called oil carry-over and can pose several problems:

- in certain CCB systems the vented gas is fed through a filter to minimise the amount of carry-over oil in the blow-by gasses, before introduction of the gasses into the intake manifold for combustion. As the filter is an expensive service item, oil carry-over increases operating costs;
- in CCB systems without a filter, the oil can cause fouling of components of the induction system such as turbocharger compressor vanes and engine poppet valves. Also, the liquid oil can form deposits on the valves which can be detrimental to the performance of the air intake system;
- in OCB systems where the gasses are vented to air, oil carry-over can raise emission levels significantly;
- oil carry-over can be a significant cause of oil loss and hence increases operating costs.

It is known to provide a PCV (Positive Crankcase Ventilation) valve to limit oil carry over. An example of such an apparatus is disclosed in U.S. Pat. No. 5,024,203. However, this design has several undesired characteristics in that it is fitted external to the engine thus enlarging the engine envelope, it requires a controlled heating process of the vapours, and several additional flow paths must be added to the engine to control the flow of the fluids involved. This combination of factors make the design complex, expensive, and introduces significant design constraints for both the engine manufacturer and the customers who wish to incorporate the engine into their products.

The present invention is directed to solving one or more of the problems set forth above.

SUMMARY OF THE INVENTION

According to a first aspect of the present invention, there is provided an internal combustion engine with a cylinder block defining a first chamber, a second chamber and a passage connecting the first chamber and the second chamber. The passage allows gas flow between the first chamber and the second chamber. The internal combustion engine further has a barrier device positioned in the cylinder block with an impact surface located in the gas flow adjacent to a downstream end of the passage. The passage has a cross-sectional area and shape such that said gas flow has a velocity causing oil particles in the gas flow to impact on the impact surface. The impact surface extends over the cross-sectional area of the passage and substantially impedes oil particles in the gas flow whilst allowing gas to flow past the impact surface.

According to a second aspect of the present invention, an internal combustion engine has a first engine component with a passage therein, a second engine component and gasket sealing between the first and the second engine components The gasket has at least one perforation to allow gas flow from the passage in the first engine component to the second engine component. The gasket includes a barrier device positioned in the gas flow adjacent to a downstream end of the passage. The passage has a cross-sectional area and shape such that the gas flow has a velocity causing oil particles in the gas flow to impact on the impact surface. The impact surface extends over the cross-sectional area of the passage and substantially impedes oil particles in the gas flow whilst allowing gas to flow past the impact surface.

DETAILED DESCRIPTION

For clarity the following description refers to a single cylinder engine only, but the principle can of course as easily be applied to multiple cylinder engines.

Figure 1:
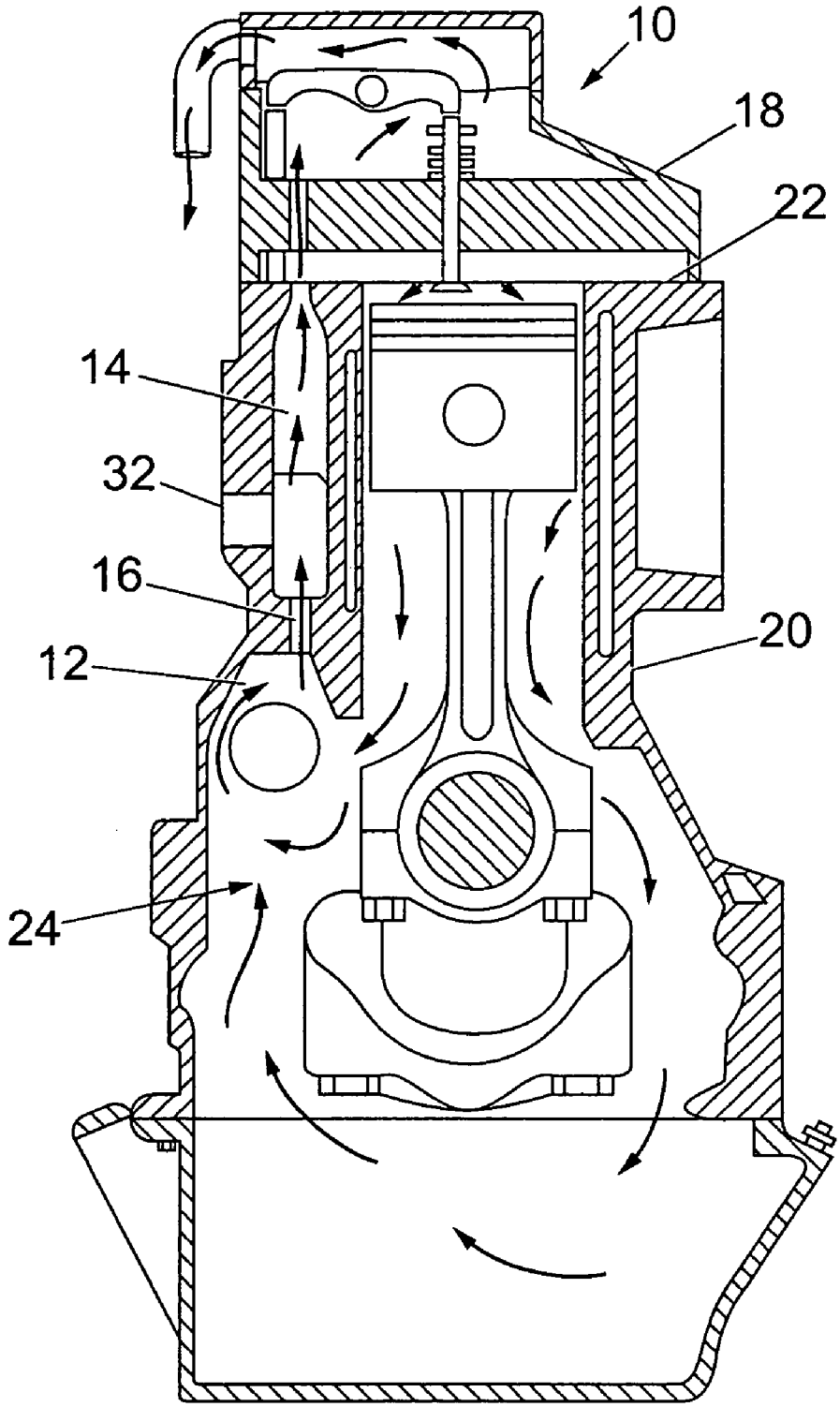
FIG. 1 is a cross-sectional view of an internal combustion engine indicating the flow path of the gasses that are to be vented from the crankcase.

With reference to FIG. 1. an internal combustion engine 10 according to this invention has a first chamber such as a tappet or camshaft chamber 12, a second chamber such as a vent chamber 14 and a passage 16 connecting the two chambers. Engine 10 further comprises a cylinder head 18, a cylinder block 20, a gasket 22 positioned between cylinder block 20 and cylinder head 18 and a crankcase 24. Blow-by gasses to be vented from crankcase 24 flow from crankcase 24 through respectively tappet chamber 12, passage 16, vent chamber 14, and gasket 22 to cylinder head 18. The oil particles carried by the gasses are mainly introduced before the gasses enter passage 16.

Four embodiments of this invention are described below in detail. Generally, each embodiment comprises an impact surface which is positioned adjacent to the downstream side of a passage connecting a first chamber and a second chamber. The impact surface extends over the passage in such a manner that substantially all gas flow is directed onto this impact surface. The passage has a both pre-determined cross-sectional area and shape such that the gas flow through the passage maintains or obtains a velocity within a pre-determined velocity range so it causes the oil particles carried by the gas flow to impact on the impact surface preferably with minimal atomisation of the particles on impact. The gas flow can continue, but the inertial impact of the oil particles on the impact surface cause the oil particles to coagulate and form oil droplets. As the droplets reach a certain size they depart from the impact surface and the droplets return to the first chamber.

Figure 2:
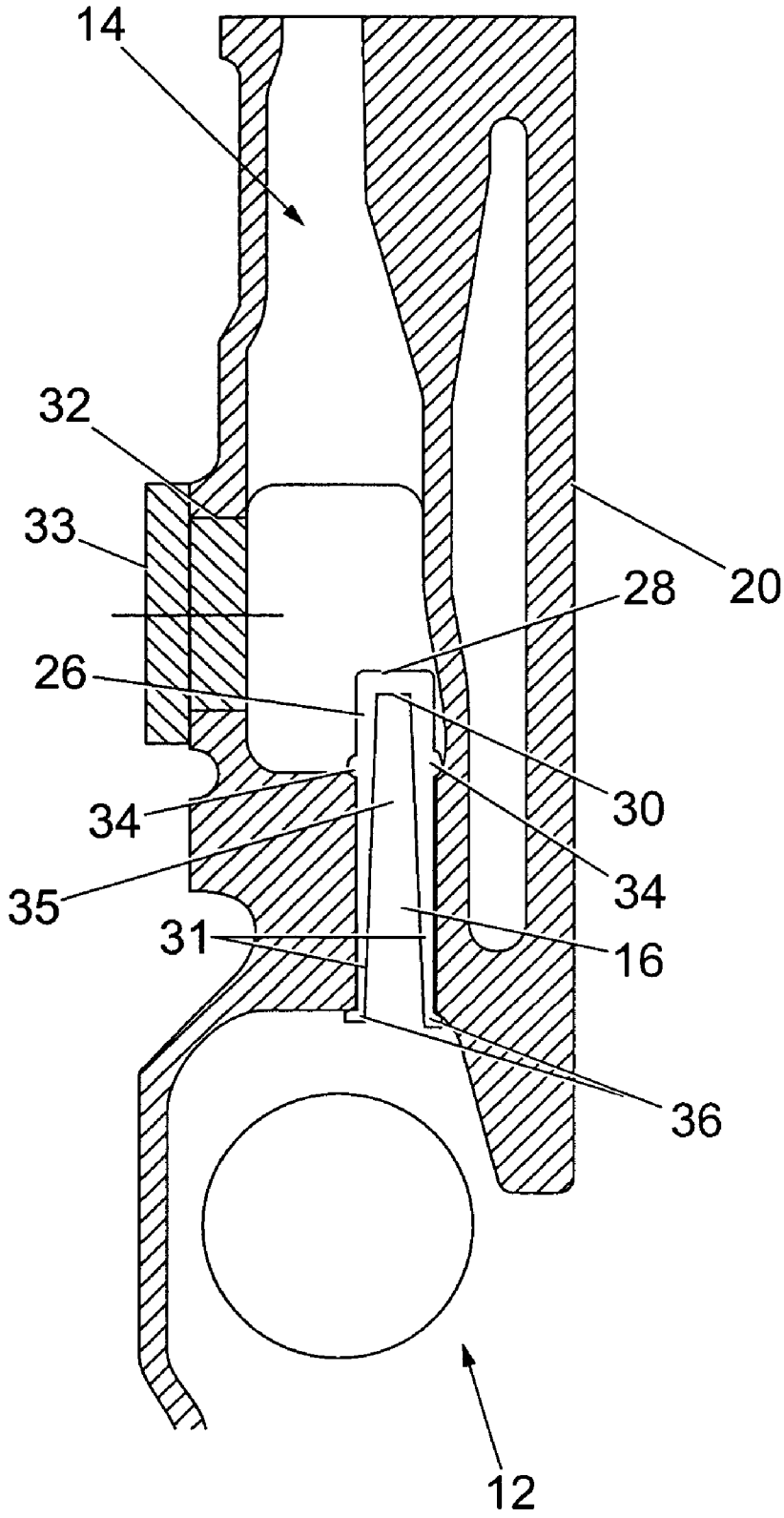
FIG. 2 is a fragmentary cross-sectional view of a portion of an internal combustion engine illustrating a first embodiment of the present invention.
Figure 3:
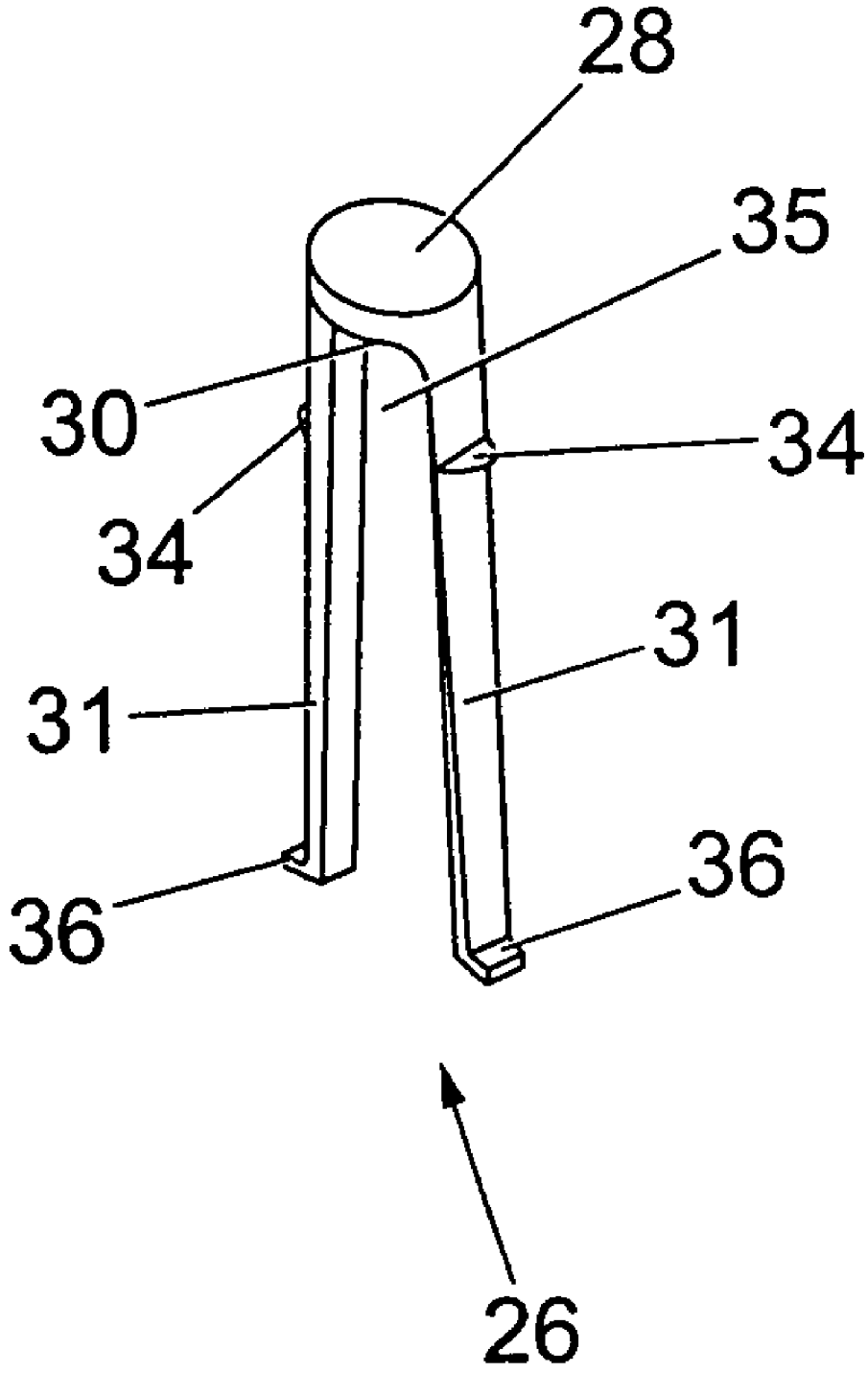
FIG. 3 is a perspective view of a barrier device as illustrated in FIG. 2.

FIGS. 2 and 3 illustrate a first embodiment of this invention. A barrier device, generally designated 26, is positioned adjacent to passage 16 in cylinder block 20. Barrier device 26 is preferably made from a plastic material, but other suitable materials such as metals or composites can also be used. Barrier device 26 comprises impact member 28 having impact surface 30 and at least one but preferably two or more locating portions or supporting members 31 having lower abutments 34 and upper abutments 36. Supporting members 31 in combination with abutments 34 and 36 secure barrier device 26 by means of a snap-fit in passage 16.

Barrier device 26 is fitted in chamber 14 via aperture 32. After fitting barrier device 26 and carrying out any other desired operations, aperture 32 is closed off by for example press-fitting or threading plug 33 into aperture 32.

The gas flow carrying the oil particles travels at a velocity within a desired velocity range after leaving passage 16. The gas flow continues by flowing through apertures 35 between supporting members 31. The inertia of the oil particles causes the oil particles to impact on impact surface 30, and thus the oil particles coagulate to form oil droplets. As the droplets reach a certain size they depart from impact surface 30 and the droplets either fall back through passage 16 or run back via supporting members 31 into tappet chamber 12.

Figure 4:
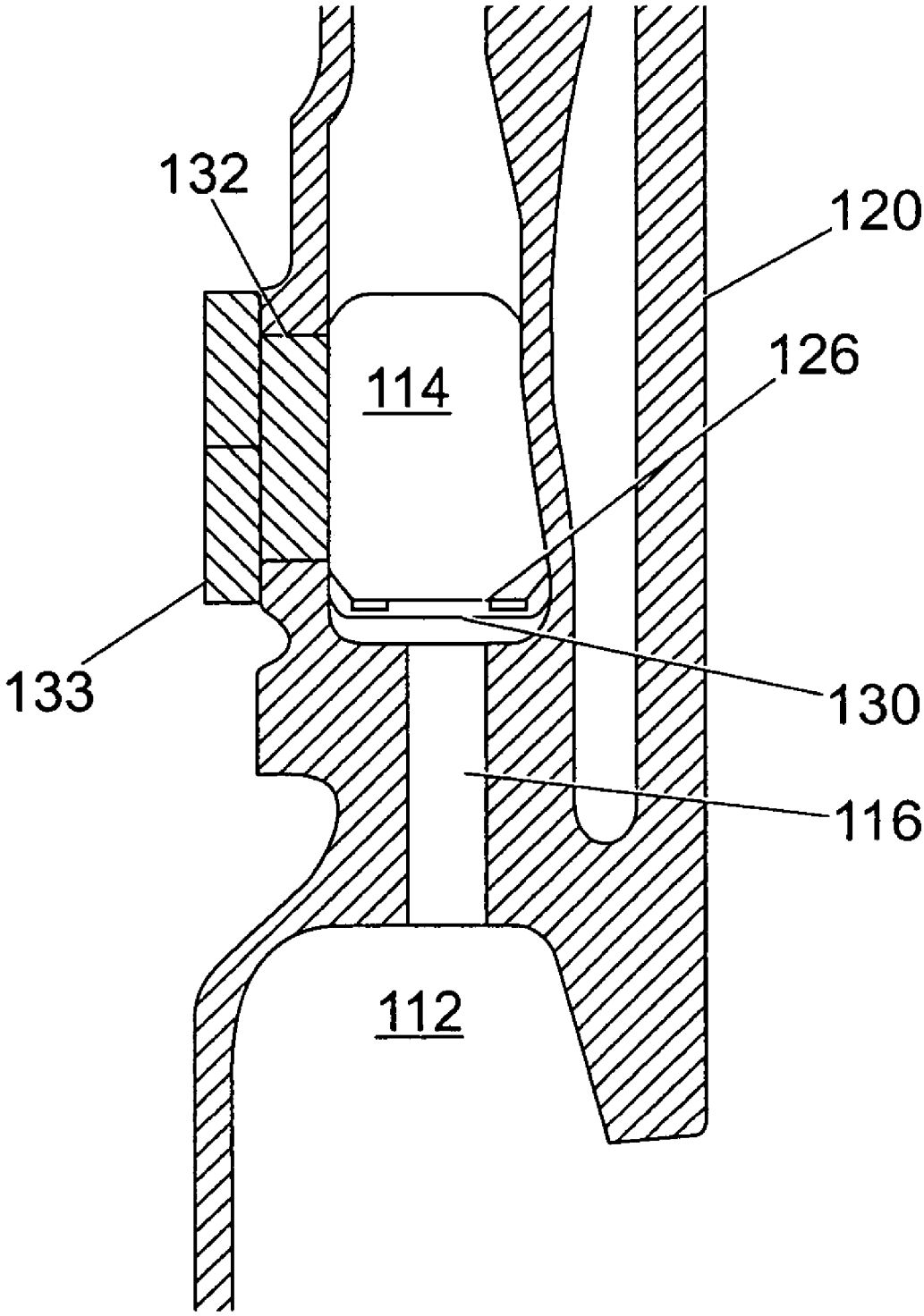
FIG. 4 is a fragmentary cross-sectional view of a portion of an internal combustion engine illustrating a second embodiment of the present invention.
Figure 5:
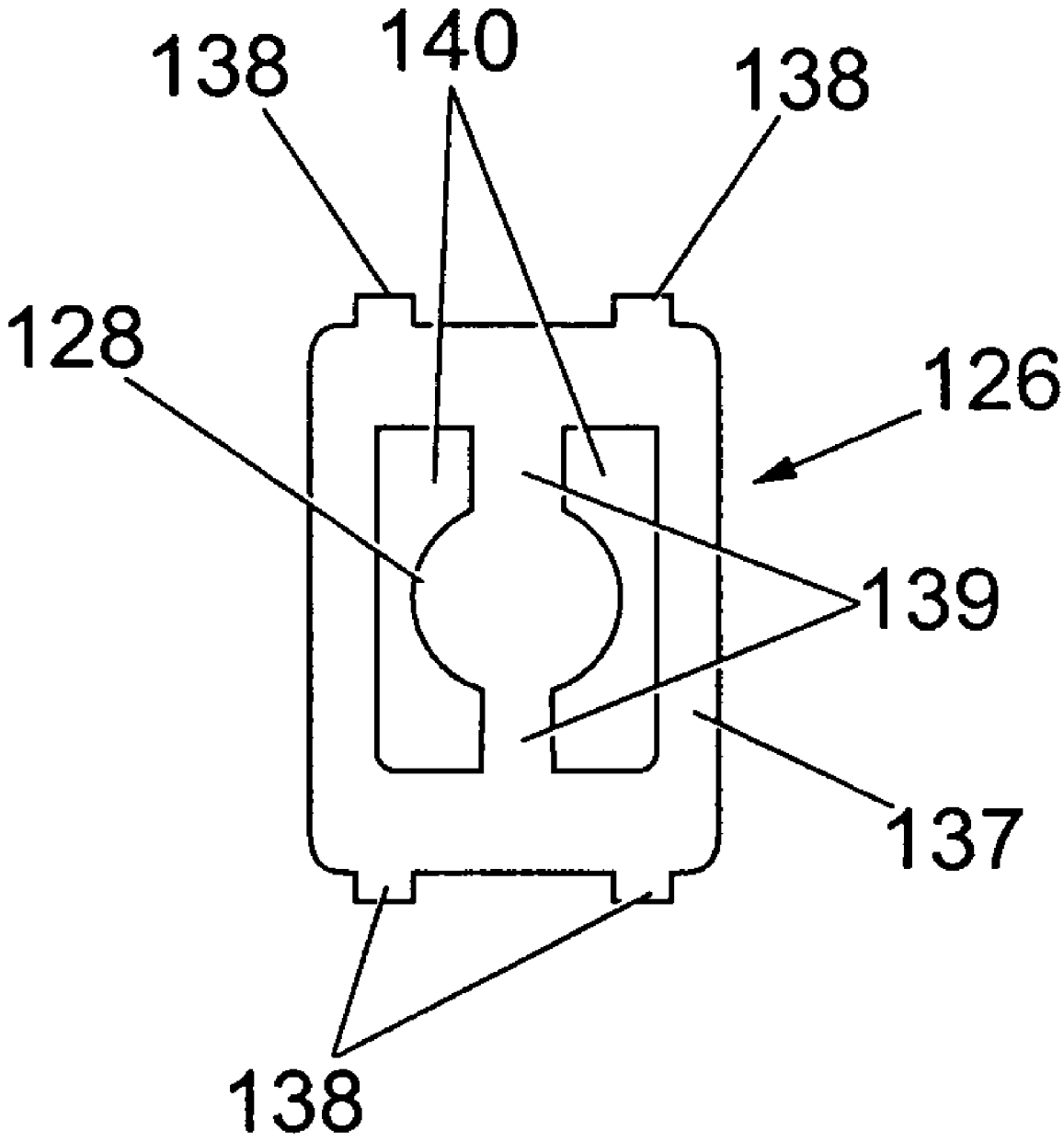
FIG. 5 is a plan view of a barrier device as illustrated in FIG. 4.

FIGS. 4 and 5 show a second embodiment of the present invention, wherein a barrier device, generally designated 126, is fitted adjacent to the downstream side of passage 116 in cylinder block 120. Barrier device 126 is preferably made from a plastic material, but other suitable materials such as metals or composites can also be used. Barrier device 126 comprises a body 137 having a generally rectangular shape, but the body 137 could have any other suitable shape. Body 137 comprises a plurality of locating portions such as tabs 138, an impact member 128 having impact surface 130, cross-members 139, and one or more perforations 140.

Barrier device 126 is fitted in chamber 114 via aperture 132. After fitting barrier device 118 and carrying out any other desired operations, aperture 132 is closed off by for example press-fitting or threading plug 133 into aperture 132.

Barrier device 126 is secured by engaging locating portions 138 in receiving portions such as recesses (not shown) formed by the walls that define chamber 114.

The gas flow carrying the oil particles travels at a velocity within a desired velocity range after leaving passage 116. The gas flow continues by flowing through perforations 140. The inertia of the oil particles causes the oil particles to impact on impact surface 130, and thus the oil particles coagulate to form oil droplets. As the droplets reach a certain size they depart from impact surface 130 and the droplets fall back through passage 116.

Figure 7:
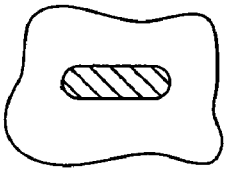
FIG. 7 is a fragmentary cross-sectional view taken along line 7—7 of FIG. 6.
Figure 8:
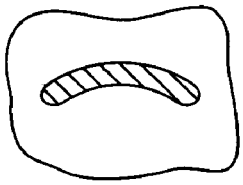
FIG. 8 is a fragmentary cross-sectional view similar to FIG. 7, but showing an alternative arrangement.
Figure 6:
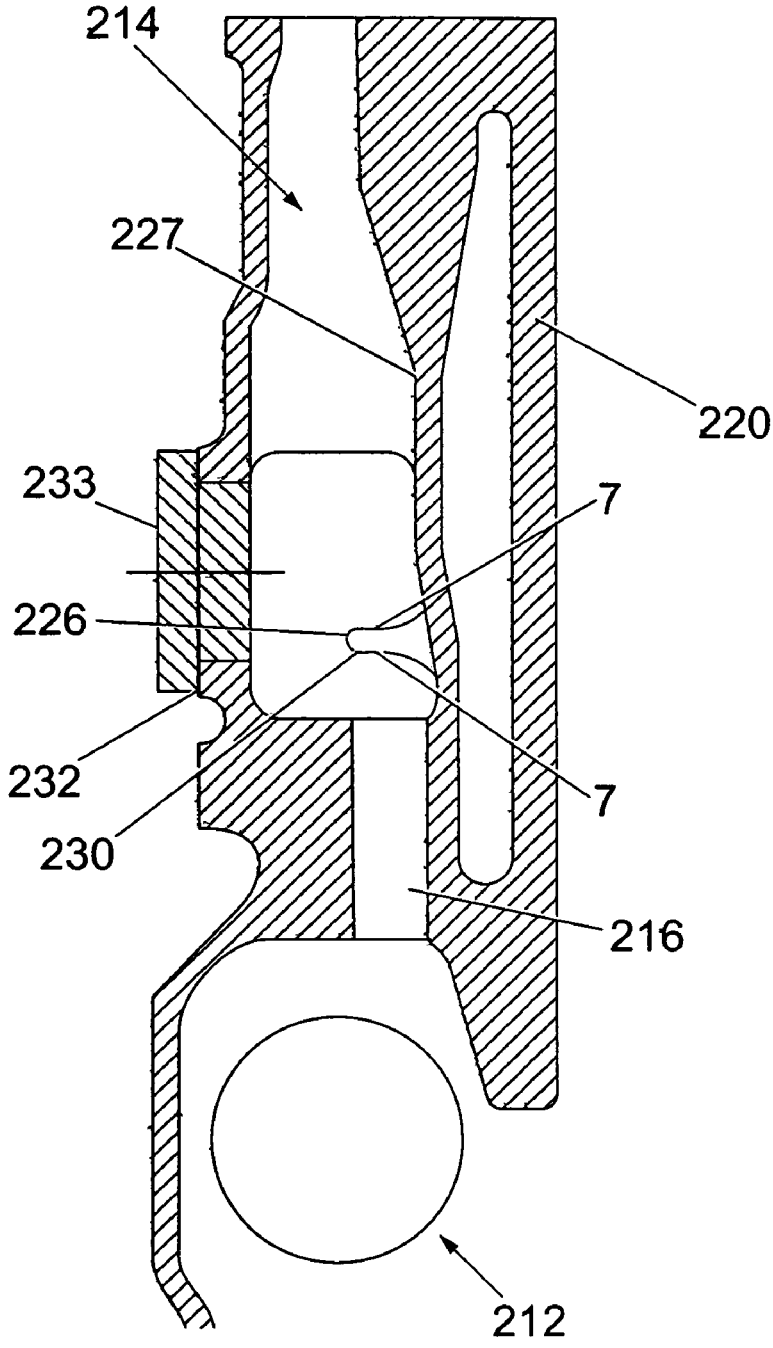
FIG. 6. is a fragmentary cross sectional view of a portion of an internal combustion engine illustrating a third embodiment of the present invention.

FIGS. 6, 7, and 8 illustrate a third embodiment of the present invention, wherein a barrier device 226 projects from an inner wall surface 227 of cylinder block 220 adjacent to the downstream side of passage 116. Impact member 226 is preferably made from metal, but other suitable materials such as plastics or composites can also be used. Barrier device 226 can be an integral cast part of cylinder block 220 or, alternatively it can be fitted after block 220 has been cast by methods well known to those skilled in the art, such as a press-fit or by using an adhesive.

If barrier device 226 is fitted after casting of cylinder block 220, barrier device 226 is fitted in chamber 214 via aperture 132. After fitting barrier device 226 and carrying out any other desired operations, aperture 232 is closed off by for example press-fitting or threading plug 233 into aperture 232.

The gas flow carrying the oil particles travels at a velocity within a desired velocity range after leaving passage 216. The gas flow continues by flowing around impact member 226. The inertia of the oil particles causes the oil particles to impact on impact surface 230, and thus the oil particles coagulate to form oil droplets. As the droplets reach a certain size they depart from impact surface 230 and the droplets fall back through passage 216.

An alternative shaped barrier device is shown in FIG. 8 wherein impact surface 230 is arcuate as opposed to the generally flat surface as shown in FIGS. 6 and 7.

Figure 9:
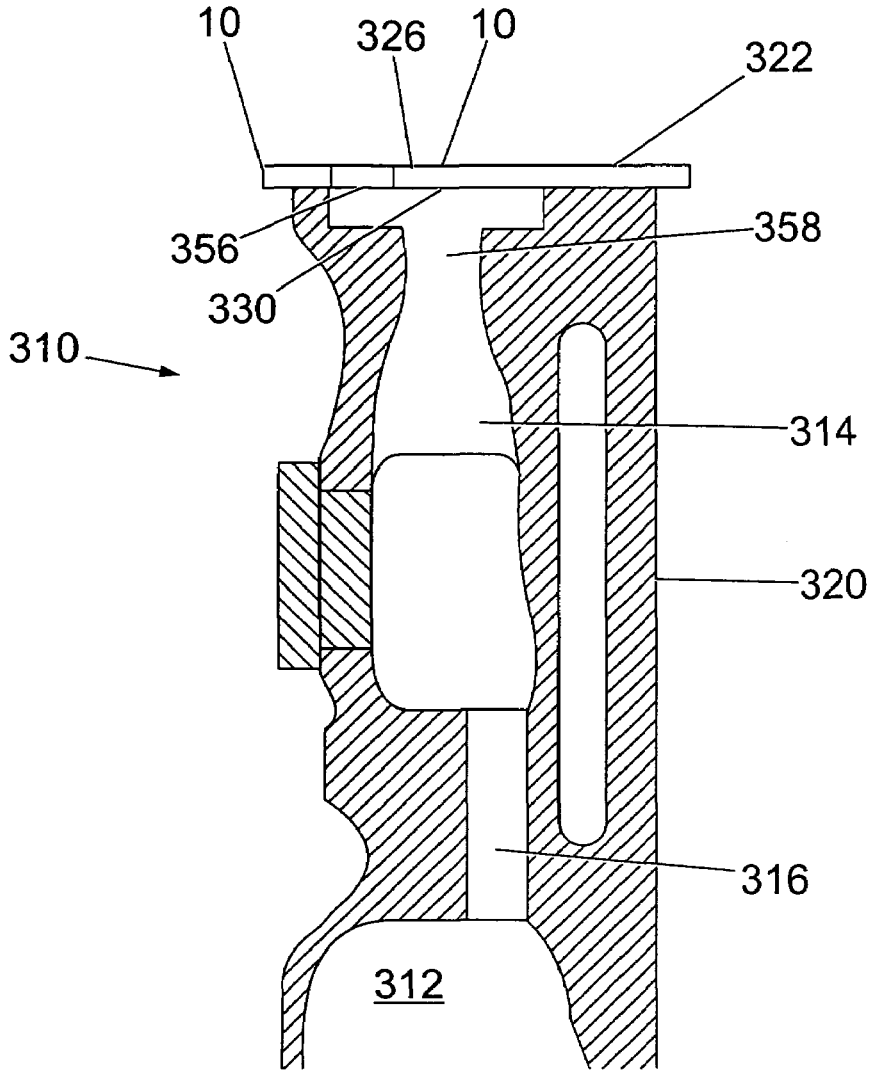
FIG. 9 is a fragmentary cross sectional view of a portion of an internal combustion engine illustrating a fourth embodiment of the present invention.
Figure 10:
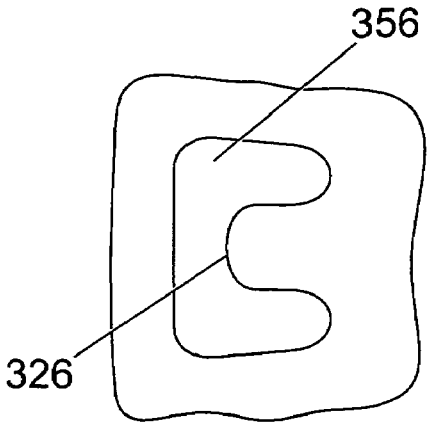
FIG. 10 is a fragmentary, top plan view looking in the direction of arrows 10—10 of FIG. 9.

In FIGS. 9 and 10 an internal combustion engine 310 comprises a cylinder block 320, a cylinder head (not shown) and a gasket 322 disposed between cylinder block 320 and the cylinder head. Gasket 322, which can be conventional except as described herein, comprises a body 350, at least one barrier device or impact portion 326 projecting from body 350 having impact surface 330, and at least one perforation 356. Gasket 322 can be considered part of cylinder block 320 for the purpose of this invention. Cylinder block 320 comprises vent chamber 314 having throat area 358, passage 316 and tappet chamber 312.

The embodiment shown in FIGS. 9 and 10 uses the same general principle as described with regards to FIGS. 2 to 8 with the main difference being the impact member has been repositioned.

Impact portion 326 is positioned in such a manner that the gas flow carrying the oil particles leaving throat area 358 of chamber 314 are obstructed by impact portion 326. Throat area 358 has a both pre-determined cross-sectional area and shape such that the gas flow through the throat area maintains or obtains a velocity within a pre-determined velocity range so it causes the oil particles carried by the gas flow to impact on the impact surface 330 preferably with minimal atomisation of the particles on impact. Therefore throat area 358 functions similarly to passages 16, 116 and 216 as described above. Consequently, throat area 358 can be considered a passage for purposes of this invention.

The gas flow carrying the oil particles travels at a velocity within a desired velocity range after leaving throat area 358. The gas flow continues by flowing around impact portion 326. The inertia of the oil particles causes them to impact on impact surface 330, and thus the oil particles coagulate to form oil droplets. As the droplets reach a certain size they depart from impact surface 330 and the droplets fall and run back through vent chamber 314 into passage 316 and then into tappet chamber 312.

Industrial Applicability

In use, this invention provides a simple and robust solution to reduce the amount of liquid oil particles carried over to a crankcase ventilation oil filter or to the induction system of an engine. Gas flow from the crankcase 24 passes through a passage 16, 116, 216, 358 formed in the cylinder block 20, 120, 220, 320. This ensures that oil particles carried by the gas flow have sufficient inertia that they impact against an impact surface 30, 130, 230, 330 positioned adjacent to the downstream end of the passage. However, the gas flow may continue past the impact surface 30, 130, 230, 330. As a result, oil particles are removed from the gas flow, and the oil particles can coagulate to form droplets that then return to the crankcase and engine sump.

This invention can be readily fitted to existing engine designs without requiring substantial modification to the engine design. Moreover, because the invention is generally contained within the engine, the benefits of the invention can be obtained without increasing the space claim of the engine. In some cases, this invention may also be fitting to existing engines.

This invention is particularly useful in engine application that are likely to generate high levels of oil particles carried by the crankcase gases. One example of such an application is an engine for a hydraulic excavator. In a hydraulic excavator, the repeated slewing of the excavator during digging operations can cause increased splashing of oil within the engine, thereby increasing the likelihood that small oil particles will travel with the gas flow. For applications that present particularly high levels of oil particles in the gas flow, those skilled in the art will recognize that one of more of the embodiments of FIGS. 2–8 can be combined with the embodiment of FIGS. 9–10 to further reduce oil carry over.

Although the preferred embodiments of this invention have been described, improvements and modifications may be incorporated without departing from the scope of the following claims.

What is claimed is:

1. An internal combustion engine comprising:

a cylinder block defining a first chamber, a second chamber, and a passage connecting said first chamber and said second chamber, said passage being configured to develop a gas flow between said first chamber and said second chamber; and a barrier device positioned in and removably attached to said cylinder block, the barrier device having an impact surface adjacent to a downstream end of said passage and extending across at least a majority of the cross-sectional area of the passage, said impact surface and said passage being configured to cause at least some of the oil particles in the gas flow to impact on said impact surface while allowing the gas to flow past the impact surface.

2. An internal combustion engine according to claim 1, wherein said impact surface and said passage are configured to cause substantially all the oil particles in the gas flow to impact said impact surface.

3. An internal combustion engine according to claim 1, wherein said barrier device has at least one locating portion extending in said passage.

4. An internal combustion engine of claim 1, wherein said barrier device includes a body having at least one perforation to allow gas to flow past the barrier device.

5. An internal combustion engine according to claim 1, wherein said barrier device is secured in said cylinder block by a snap-fit arrangement.

6. An internal combustion engine according to claim 1, wherein said barrier device has at least one locating portion engaged with said cylinder block to position said impact surface in the gas flow.

7. An internal combustion engine according to claim 1, wherein the impact surface of the barrier device extends across substantially all of the cross-sectional area of the passage.

8. An internal combustion engine according to claim 1, wherein the passage is configured to direct the gas flow so that at least some of the oil particles in the gas flow impact on the impact surface.

9. An internal combustion engine according to claim 1, wherein the passage is configured to accelerate the gas flow and cause at least some of the oil particles in the gas flow to impact on the impact surface.

10. An internal combustion engine according to claim 1, wherein the barrier device includes an impact member, the impact member forming the impact surface, wherein the passage has a length greater than the thickness of the impact member.

11. An internal combustion engine according to claim 1, wherein said barrier device includes a first and a second locating portion extending into the passage, the first and second locating portions defining apertures that allow the gas to flow past the impact surface.

12. An internal combustion engine according to claim 3, wherein the passage is configured to direct the gas flow so that at least some of the oil particles in the gas flow impact on the impact surface.

13. An internal combustion engine according to claim 3, wherein the passage is configured to accelerate the gas flow and cause at least some of the oil particles in the gas flow to impact on the impact surface.

14. An internal combustion engine according to claim 3, wherein the at least one locating portion extends entirely through said passage.

15. An internal combustion engine according to claim 3, wherein the locating members include at least one abutment formed thereon to locate the locating member in the passage.

16. An internal combustion engine comprising:

a cylinder block defining a first chamber, a second chamber, and a passage connecting said first chamber and said second chamber, said passage being configured to develop a gas flow between said first chamber and said second chamber; and a barrier device positioned in said cylinder block and secured by a snap-fit arrangement, the barrier device having an impact surface adjacent to a downstream end of said passage and extending across at least a majority of the cross-sectional area of the passage, said impact surface and said passage being configured to cause at least some of the oil particles in the gas flow to impact on said impact surface while allowing the gas to flow past the impact surface.

17. An internal combustion engine comprising:

a cylinder block defining a first chamber, a second chamber, and a passage connecting said first chamber and said second chamber, said passage being configured to develop a gas flow between said first chamber and said second chamber;

a barrier device positioned in said cylinder block, the barrier device having an impact surface adjacent to a downstream end of said passage and extending across at least a majority of the cross-sectional area of the passage, said impact surface and said passage being configured to cause at least some of the oil particles in the gas flow to impact on said impact surface while allowing the gas to flow past the impact surface; and wherein said barrier device has at least one locating portion extending entirely through said passage.

* * * * *